United States Patent [19]

Black

[11] Patent Number: 4,461,242

[45] Date of Patent: Jul. 24, 1984

[54] MEANS FOR HEATING WATER BY WOOD BURNING

[75] Inventor: Milton W. Black, Gibbon, Minn.

[73] Assignee: Northern Leader, Inc., New Hope, Minn.

[21] Appl. No.: 310,885

[22] Filed: Oct. 13, 1981

Related U.S. Application Data

[63] Continuation-in-part of Ser. No. 131,524, Mar. 18, 1980, abandoned, which is a continuation-in-part of Ser. No. 935,370, Aug. 21, 1978, Pat. No. 4,201,185.

[51] Int. Cl.[3] ..... F22B 5/00

[52] U.S. Cl. ..... 122/15; 126/65; 126/77; 126/83; 126/362; 126/101; 126/132; 126/193; 126/290; 237/8 R; 237/56

[58] Field of Search ..... 126/34, 35, 60, 61, 126/65-67, 77, 83, 101, 132, 193, 290, 361, 362, 367, 368; 122/15; 236/9 A; 237/8 R, 56

[56] References Cited

U.S. PATENT DOCUMENTS

| | | | |
|---|---|---|---|
| 517,321 | 3/1894 | Allingham | 126/83 |
| 719,271 | 1/1903 | Smith | 126/112 |
| 1,569,220 | 1/1926 | Downe | 126/67 |
| 1,710,665 | 4/1929 | Mertzanoff | 122/15 |
| 1,856,693 | 5/1932 | Corbin, Jr. | 122/15 |
| 2,513,443 | 7/1950 | Barlow | 126/68 |
| 2,549,788 | 4/1951 | Fellows | 126/73 |
| 2,864,358 | 12/1958 | Harding | 126/77 |
| 3,237,622 | 3/1966 | Best | 126/77 |
| 4,030,479 | 6/1977 | Webb | 126/287 |
| 4,121,560 | 10/1978 | Knight | 126/63 |
| 4,154,212 | 5/1979 | Wilkinson | 126/77 |
| 4,159,801 | 7/1979 | Roland | 237/8 R |
| 4,163,440 | 8/1979 | Stultz | 126/60 |
| 4,186,718 | 2/1980 | Goodwin | 126/67 |
| 4,194,487 | 3/1980 | Cadwallader et al. | 126/61 |
| 4,213,443 | 7/1980 | Morande, Jr. | 126/72 |
| 4,303,198 | 12/1981 | Dulac | 237/56 |

FOREIGN PATENT DOCUMENTS

| | | | |
|---|---|---|---|
| 513859 | 2/1921 | France | 126/65 |

OTHER PUBLICATIONS

"Woodland F-20 Fireplace Stove" in *Woodstove Fireplace and Equipment Directory*, vol. III, 1980, Copyright 1979 by Energy Communications Press, Inc., Manchester, NH, p. 109.

*Primary Examiner*—Samuel Scott
*Assistant Examiner*—Margaret A. Focarmo
*Attorney, Agent, or Firm*—Zarley, McKee, Thomte, Voorhees & Sease

[57] ABSTRACT

The wood burning water heating means of the present invention utilizes a firebox having a grate adjacent the lower end and a flue opening positioned downward from the upper end thereof. The flue extends into the firebox so as to deflect rising hot gases prior to their exit through the flue opening. A main draft opening provides communication of air below the grate to provide oxygen for the fire. A secondary draft opening is provided above the grate for introducing air in such a manner that oxygen will be provided immediately below the flue to facilitate combustion.

7 Claims, 6 Drawing Figures

MEANS FOR HEATING WATER BY WOOD BURNING

BACKGROUND OF THE INVENTION

This is a continuation-in-part of application Ser. No. 131,524, filed Mar. 18, 1980 now abandoned, which is a continuation-in-part of application Ser. No. 935,370, filed Aug. 21, 1978, now Pat. No. 4,201,185, issued May 6, 1980.

This invention relates to a means for heating water by wood burning.

Conventional wood burning stoves or furnaces generally include a firebox having a main draft for introducing air below the grate in the bottom of the firebox and additionally having a flue outlet opening adjacent the upper end thereof. The flue outlet of the prior application, Ser. No. 131,524, is at the upper end of the firebox. This location is not desirable for a water heater because the upper end of the firebox is the hottest place in the furnace, thus failing to maximize the potential heat transfer.

A problem commonly encountered with conventional wood burning stoves and furnaces arises from the fact that often the tars and other ingredients from the wood are not completely burned prior to their exit through the flue opening. This results in accumulation of tar and pitch within the flue and chimney, thereby creating a fire hazard. Furthermore, these conventional wood burning stoves and furnaces are not as efficient as they could be if not all of the wood is burned to produce heat.

Additional problems are encountered in woodburning furnaces which are used to heat water. When a water jacket is placed around the firebox of a wood burning furnace, it cools the walls of the firebox to approximately 212° F. Most woods will not burn unless heated to 500°–740° F. and temperatures approaching 1100° F. are necessary in order to provide thorough combustion of the tars and gases from the burning wood.

In the invention shown in U.S. Pat. No. 4,201,185, a baffle is used in the upper portion of the firebox to create a hot spot having temperatures of approximately 1100° F. However, different problems are encountered when such a baffle is utilized in a furnace surrounded by water. The baffle becomes much hotter than the firebox walls and it buckles and often becomes disengaged from the firebox walls in response to this temperature differential.

SUMMARY OF THE INVENTION

The present invention utilizes the firebox having a flue extending approximately half way into the firebox and positioned downward from the upper end of the firebox so as to deflect and divert the rising gases within the firebox prior to their exit through the flue opening. This positioning of the flue creates a hotter firebox, burning more gases, pitch and tar, and allows less heat to escape through the flue opening, thus giving hotter water with less fuel.

Heat alone, however, is not sufficient to provide full combustion of the gases which accumulate around the flue. Oxygen must also be provided, and this is done by a secondary draft opening which is located above the grate, and which introduces air into the firebox in such a manner that the air is drawn toward the hot spot located around the flue. This oxygen facilitates the combustion of the gases which are located at this hot spot and results in more complete combustion of the gases prior to their exit from the flue. It has been found that temperatures of approximately 1100° F. are achieved in this hot spot, and this temperature results in more complete combustion of gases, pitch and tar, thereby leaving a cleaner chimney with less chance of chimney fire.

In a preferred embodiment, the flue extends 12½ inches or more than half way into a firebox having a depth of approximately 23 inches. The flue is also spaced 4½ inches downward from the upper end of the firebox. In this position, the flue acts as a baffle, diverting the rising gases so that they mix with the oxygen from the secondary draft opening and creates a hot spot above the flue for further combustion of the gases. Also, by having the flue opening at a location other than the upper end of the firebox, there is more efficient heat transfer from the hottest area at the upper end of the firebox.

The use of a flue in the place of the baffle utilized in the air circulated furnace of Pat. No. 4,201,185, eliminates the buckling problems resulting from a temperature differential between such a baffle and water cooled firebox walls.

In order to prevent smoke from exiting through the secondary draft opening, a smoke damper is provided in covering relation over the secondary draft opening so as to cause the air entering through the secondary draft opening to move downwardly below the lower edge of the smoke damper prior to entry into the firebox.

Another advantage is obtained by virtue of the arrangement of the firebox with respect to the outer housing of the furnace. The furnace housing is spaced outwardly from the walls of the firebox in such a manner to provide a water boiler chamber around the rear, top and opposite sides of the firebox. Fresh cool water is pumped into the rear portion of the chamber and forced upward and forward through the chamber to the water outlet located on the top of the furnace. This water boiler chamber increases the efficiency of heat exchange from the firebox to the water within the boiler chamber. An aquastat is mounted within the boiler chamber to control the actuation and deactuation of the pump in response to varying temperatures within the boiler chamber. A pressure and temperature gauge and a pressure relief valve provide further monitoring of the furnace.

A further advantage is achieved by having the flue extend through the boiler chamber before entering the chimney. This permits heat to radiate from the flue into the boiler chamber where it is circulated throughout. The ventilation system thereby increases the efficient use of heat which normally would go up the chimney.

A second thermostat is provided within the boiler chamber and is connected to a main draft control which causes selective opening and closing of the main draft to control the speed with which the fire burns within the firebox.

The boiler can also be utilized to heat water for domestic hot water use. A coil tube is positioned within the boiler and may be connected to the tap lines of the building. The water within the coil is heated by the water in the boiler, thus supplementing or replacing a conventional hot water heater.

Another phenomena attained with the present invention is that extreme heat is attained inside the flue. This causes further burning of the tars, pitches and gases so that the inside of the flue remains much cleaner than with other prior wood burning furnaces.

Therefore, a primary object of the present invention is the provision of an improved means for heating water by wood burning.

A further object of the present invention is the provision of a wood burning furnace which causes more complete combustion of wood and the tars within the wood prior to the exit of the combusted gases through the flue opening.

A further object of the present invention is the provision of a means which minimizes the accumulation of tars and other impurities in the flue opening so as to minimize the fire hazard therein.

A further object of the present invention is the provision of a means which maximizes the heat achieved per unit of wood burned therein.

A further object of the present invention is the provision of a means which maximizes the heat exchanged between the firebox and the boiler chamber containing the water to be heated.

A still further object of the present invention is the provision of a means which provides a secondary draft opening for providing oxygen to the upper interior portion of the firebox.

A further object of the present invention is the provision of a means which prevents the exit of smoke through the secondary opening while at the same time permitting the entry of air through the secondary opening so as to provide oxygen and improve the combustibility of the gases within the fire chamber.

A further object of the present invention is the provision of a wood burning furnace which causes extreme heat in the area inside and outside the flue so as to more completely burn gases, pitch and tar and thereby minimize creosote build-up in the firebox, flue and chimney.

A further object is the provision of a furnace which permits maximum temperatures within the firebox to reach approximately 1100° F. even though the walls of the firebox are being cooled to approximately 212° F. by the water surrounding them.

A further object of the present invention is the provision of a device which is economical to manufacture, durable in use and efficient in operation.

DETAILED DESCRIPTION OF THE INVENTION

Figure 1:
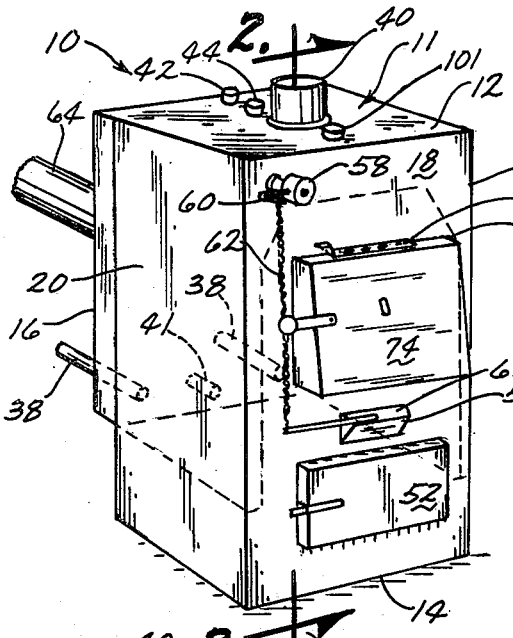
FIG. 1 is a perspective view of the present invention.

Referring to the drawings, the numeral 10 generally designates the wood burning furnace of the present invention. Furnace 10 includes an outer housing 11 comprising a top wall 12, a bottom wall 14, a rear wall 16, a front wall 18, and two lateral walls 20, 22. Within housing 11 is a firebox designated generally by the numeral 24. Firebox 24 includes a top wall 26, a bottom wall 28, a rear wall 30 and lateral side walls 32, 34. The front wall of firebox 24 coincides with front wall 18 of housing 11, but the remainder of the walls 26–34 of firebox 24 are spaced inwardly from the walls of housing 11.

Figure 3:
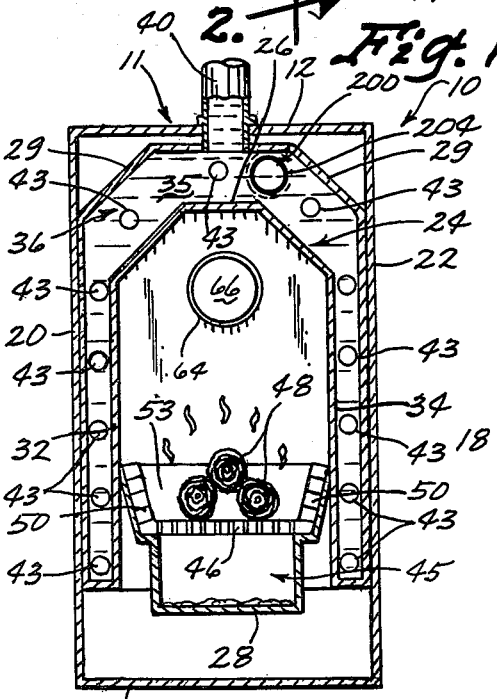
FIG. 3 is a sectional view taken along line 3—3 of FIG. 2.
Figure 4:
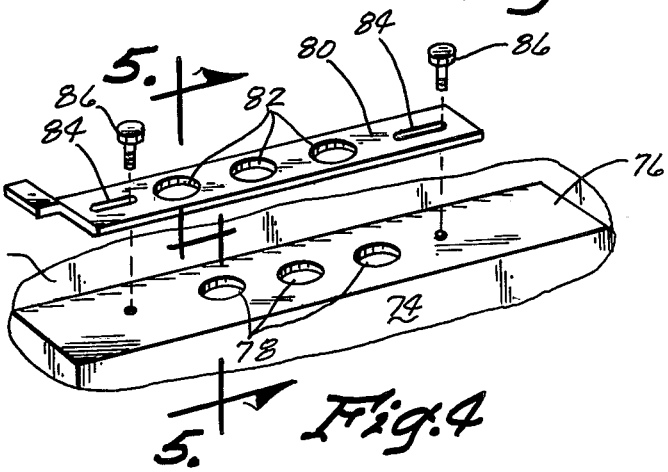
FIG. 4 is an enlarged detailed exploded arrangement view of the secondary draft opening and the closure therefor.

Referring to FIG. 3, a pair of interior side walls 29 are positioned between lateral walls 20, 22 of housing 11 and lateral walls 32, 34 of firebox 24. A circulation or boiler chamber 36 surrounds firebox 24 and is defined on the interior by walls 26, 30, 32 and 34 of firebox 24. The exterior of chamber 36 is defined on the sides by interior sidewalls 29, on the front by front wall 18 of housing 11, on the top by top wall 12 of housing 11 and on the rear by rear wall 16 of housing 11.

An inlet opening 38 is provided adjacent the bottom of the rear wall 16 and is in communication with the boiler chamber 36. Adjacent the top of boiler chamber 36 is a hot water outlet opening 40 which permits the exit of water from boiler chamber 36. An aquastat 42 is mounted to the upper portion of housing 11 and is in communication with the interior of boiler chamber 36 so as to be capable of sensing the temperature therein. Aquastat 42 is electrically connected to a pump (not shown) and is adapted to actuate and deactuate the pump in response to varying temperatures within boiler chamber 36. Also located at the bottom of rear wall 16 and in communication with boiler chamber 36, is a drain pipe 41 which allows the boiler chamber 36 to be drained when not in use. A pressure and temperature gauge 101 and a pressure release valve 44 are located on top wall 12 of housing 11.

A vertical partition wall 35 provides an extension outwardly from rear wall 30 of firebox 24 so as to divide boiler chamber 36 into a rear circulation chamber 37 and a forward circulation chamber 39. A plurality of holes or openings 43 are formed around the periphery of partition wall 35 so that water can circulate from rear circulation chamber 37 to forward circulation chamber 39. This structure permits the water to be more fully preheated in rear chamber 37 before circulating into forward chamber 39.

Within firebox 24 is a grate 46 which is spaced above bottom wall 28 and which is adapted to support the logs 48 for burning. At the sides of grate 46 are upstanding side walls 50 comprised of firebrick. At the front of grate 46 is a front plate 51 and at the back of grate 46 is a back plate 53. These plates absorb the bumps and knocks caused when logs are placed on the grate. Furthermore, rear plate 53 is slanted slightly so that it is spaced from rear wall 30 of firebox 29. This protects the burning logs from the water cooled wall 30, thereby insuring that the logs achieve their maximum temperature during burning.

Within front wall 18 adjacent the lower portion thereof is an ash pan door 52 which is adapted to be opened to provide access to the space 45 below grate 46 for removal of ashes.

Immediately above ash pan door 52 is a main draft opening 54 which provides communication from the exterior of housing 11 to the interior of the space 45 below grate 46 so as to provide oxygen for the burning wood resting on grate 46. Arrows 56 indicate the flow of air into the space 45 below grate 46.

An automatic draft control 58 is mounted on the outer surface of housing 11 and includes lever arm 60, adapted to actuate control mechanism 58 in response to variations in temperature. Connected to lever arm 60 is a chain 62 which extends downwardly and is connected to a movable closure 63 over draft opening 54, for controlling the size of draft opening 54 and thereby controlling the rate at which combustion takes place within the firebox 24. Draft control 58 is adapted to open and close draft opening 54 varying distances corresponding to the temperature sensed within the upper portion of boiler chamber 36.

Draft control 58 is of a type presently commercially available under the model number C-20 manufactured by Ammark Corporation, Fair Lawn, N.J. Other types of thermostatic controls may be used without detracting from the invention.

A flue 64 having flue opening 66 leading to a chimney extends through circulation chamber 37 and then outwardly through back wall 30 of firebox 24 and through backwall 16 of housing 11. Thus, heat is radiated from flue 64 into circulation chamber 37 so as to increase the efficiency of heat usage. Flue 64 extends approximately half way into firebox 24 and is positioned in spaced relation below the top wall 26 of firebox 24 so as to deflect the gases rising from the wood being burned on grate 46. In the preferred embodiment, the flue extends 12½ inches into the 23 inch depth of the firebox and is positioned 4½ inches below the top wall. The gases are diverted by flue 64 to the area designated by numeral 70 before passing outwardly through flue opening 66.

Flue 64 causes an increased temperature in the vicinity of area 70, and this increased temperature facilitates further combustion of gases rising from the wood 48 on grate 46. Flue 64 is preferably made from 5/16 inch steel such as commonly used for well casings. This heavy construction prevents the inner end of flue 64 from drooping after extended exposure to high temperatures.

Figure 5:
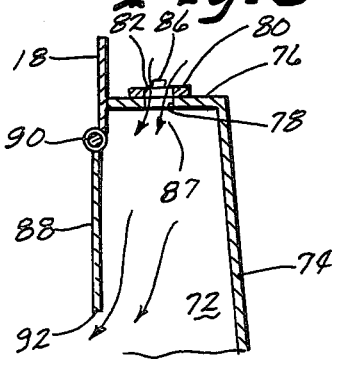
FIG. 5 is a sectional view taken along line 5—5 of FIG. 4.

In order to provide oxygen to area 70 to provide more complete combustion of the gases located at area 70, a secondary draft is provided above grate 46 in the following manner. A door opening 72 is provided in front wall 18 of housing 11. Mounted in covering relation over door opening 72 is a door 74 which is hinged at one lateral edge and which is adapted to be opened to provide access to the interior of firebox 24. Door 74 includes a horizontal upper wall 76 which is provided with a plurality of draft holes 78 providing communication from the exterior of housing 11 through horizontal wall 76 into the interior of fire chamber 24. Mounted for sliding movement over holes 78 is a template 80 which has a plurality of openings 82 sized and positioned to correspond in registered alignment over opening 78. A pair of slots 84 are provided in the opposite ends of plate 80 and slidably receive screws 86 which are threadably mounted to wall 76. Slots 84 permit longitudinal sliding movement of plate 80 from a position wherein plate 80 closes opening 78 to a position wherein openings 82 are in registered alignment with holes 78 thereby permitting air to enter holes 78 and gain entrance to firebox 24 as indicated by arrows 87 in FIGS. 2 and 5.

Figure 2:
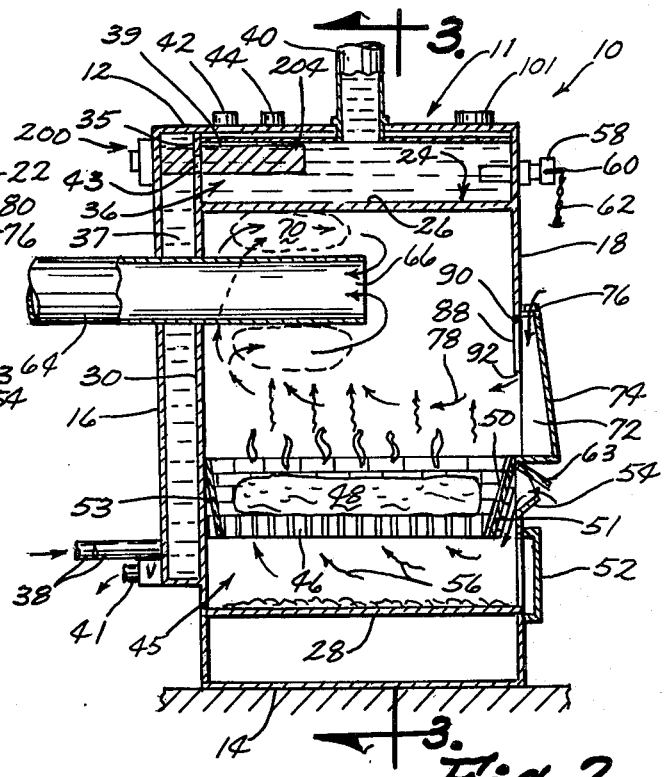
FIG. 2 is a sectional view taken along line 2—2 of FIG. 1.

As can be seen in FIG. 2, the rising gases from the burning logs 48 cause the air entering holes 78 to drift upwardly toward flue 64, thereby introducing oxygen adjacent area 70 facilitating the further burning of the gases located at area 70. The combination of the increased heat at area 70, together with the introduction of fresh oxygen at area 70, causes the tars and other unburned gases to be more fully combusted than in previous prior art devices.

The design of the flue 64 extending into the firebox approximately halfway is unique as this design allows extreme heat to build up adjacent opening 66 and area 70. This causes the flue 64 to be cleaner, both inside and out, than flues of prior woodburning furnaces.

In order to prevent smoke from exiting through holes 78, a smoke damper 88 is provided adjacent the upper margin of door openings 72. Damper 88 is hinged at its upper edge by means of a hinge 90, and extends downwardly therefrom to its lower edge 92. Thus, damper 88 blocks the passage of smoke upwardly and outwardly through holes 78 while at the same time permitting air to enter opening 78 to pass downwardly below the lower edge 92 of damper 88 and thence inwardly to area 70. Hinge 90 permits damper 88 to be folded upwardly out of the way during the insertion of logs through opening 72.

Another advantage achieved by damper 88 is that it causes preheating of the air before the air reaches the interior of firebox 24. This is important in order to prevent the air from lowering the temperature within firebox 24.

Figure 6:
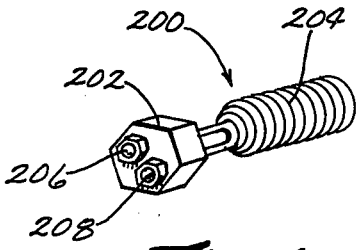
FIG. 6 is a perspective view of the domestic hot water coil utilized in the present invention.

The present invention can also be utilized to heat tap water, thereby supplementing or eliminating a conventional hot water heater. A tap water heating device 200 (FIG. 6) includes a threaded plug 202 and a copper tube coil 204. Coil 204 is connected to an inlet coupling 206 and an outlet coupling 208 in plug 202 for coupling to a tap water circulation system. Plug 202 is threaded into the rear wall 16 of furnace 10 with coil 204 extending within the water circulation chamber 24 as shown in FIGS. 2 and 3. The heat from the water within chamber 24 is thus transferred to the tap water within coil 204 to heat the tap water.

The result of the above described structure permits the furnace of the present invention to give more heat and use less wood than other prior art wood stoves or furnaces. The design of the stove also retards a buildup of pitch in the chimney. It gives more heat than prior art devices with less pitch or soot accumulation in the chimney. Furthermore, the circulation chamber of water around four of the six sides of firebox 24 and also around flue 64 permits a more complete heat exchange to the water being circulated through circulation chamber 36, thereby making the furnace more efficient. The introduction of cool water through inlet pipes 38 at the bottom of rear wall 16 of housing 11, rather than at the top of the furnace as in other prior art water heaters, also makes the furnace more efficient.

Thus, it can be seen that the device accomplishes at least all of its stated objectives.

What is claimed is:

1. A wood burning furnace comprising:

a furnace housing having front and rear walls, opposite side walls, and top and bottom walls, a firebox within said furnace housing having a front wall joined to said front wall of said housing, the remainder of said firebox being spaced inwardly from at least some of said rear, side, top and bottom walls of said housing to define a boiler chamber therebetween, said top wall of said housing having an inlet opening in communication with said boiler chamber; said rear wall of said housing having an inlet opening in communication with said boiler chamber;

a flue extending through said housing and said boiler chamber and extending approximately half way into said firebox and being in spaced relation below said top wall of said firebox;

said front walls of said firebox and said housing being provided with a door opening having an upper edge and a lower edge and providing communication from the exterior of said firebox to the interior of said firebox;

a door having upper and lower edges and being positioned in covering relation over said door opening;

a main draft opening in said firebox adjacent the bottom thereof and below said door opening, said main draft opening providing communication of air from the exterior of said housing to the interior of said firebox;

a secondary draft opening in said firebox above said main draft opening and providing communication of air from the exterior of said housing to the interior of said firebox, said secondary draft opening comprising at least one hole in said door adjacent said upper edge of said door;

smoke damper means positioned between said secondary draft opening and the interior of said firebox to prevent smoke from exiting said secondary draft opening, said damper means having an upper edge and a lower edge, said upper edge of said damper means being hinged about a horizontal axis adjacent said upper edge of said door opening whereby said damper means may be pivoted inwardly about said horizontal axis during insertion of wood into said firebox through said door opening;

said lower edge of said damper means being spaced downwardly from said flue and said secondary draft opening and upwardly above said main draft opening whereby fresh air will pass from said secondary draft opening downwardly below said lower edge of said damper means and will mix with and be heated by hot gases which are rising within said firebox before said hot gases reach said flue.

2. A furnace according to claim 1 wherein said firebox is spaced inwardly from all of said top, bottom, rear, and side walls of said housing wherein said boiler chamber extends above, to the rear and to each opposite side of said firebox.

3. A furnace according to claim 2 wherein a pump is connected to said intake opening for circulating water through said boiler chamber and outwardly through said outlet opening an aquastat positioned within said boiler chamber, and means connecting said aquastat to said pump for controlling the actuation and deactuation of said pump in response to temperature changes within said boiler chamber.

4. A furnace according to claim 1 wherein a draft control means is mounted on said housing and comprises a power means, a chain connected to said power means, and a main draft door over said main draft opening, temperature sensing means within said boiler chamber, and responsive to temperature changes within said boiler chamber to acturate and deacturate said power means whereby actuation of said power means causes said chain to move said main draft door for controlling the amount of air permitted to enter said main draft opening.

5. A furnace according to claim 1 wherein water is within said circulation chamber, a tap water heating device being mounted to one of said walls of said furnace housing, said tap water heating device including a coil tube extending within said circulation chamber and coupling means outside said furnace housing for connecting said coil tube to a tap water circulation system.

6. A furnace according to claim 1 wherein a draft adjustment means is mounted over said hole in said door, said adjustment means comprising a plate mounted over said hole for sliding movement from a first position exposing said hole to the atmosphere to a second position covering said hole and preventing air from entering said hole.

7. A wood burning furnace comprising:

a furnace housing having a firebox therein, said firebox having upper and lower ends, a flue extending through said housing and into said firebox and terminating in an inner end located approximately at the vertical centerline of said firebox;

a grate within said firebox and spaced downwardly from said upper end of said firebox for supporting burning fuel whereby the heated gases from said burning fuel will rise and exit from said firebox through said flue;

a main draft opening in said housing positioned to provide communication of air from the exterior of said housing to the interior of said firebox adjacent said grate;

said flue being positioned in spaced relation below the top of said firebox and above said grate so as to deflect rising partially combusted gases and thereby delay their exit through said flue;

a secondary draft opening within said housing positioned in spaced relation above said grate and spaced relation below said flue;

a smoke damper positioned between said secondary draft opening and the interior of said firebox to prevent smoke from exiting said secondary draft opening, said smoke damper being hinged about a horizontal axis and having a lower edge below said secondary draft opening whereby fresh air passes from said secondary draft opening below said lower edge of said damper and will mix with and be heated by said rising gases prior to the time that said gases reach said flue;

the relative positions of said secondary draft opening, said main draft opening, said smoke damper, and said flue causing said rising gases to create a hot spot adjacent said flue, said hot spot having a temperature of approximately 1100° F.

* * * * *